US008155776B2

(12) United States Patent
Bittner et al.

(10) Patent No.: US 8,155,776 B2
(45) Date of Patent: Apr. 10, 2012

(54) AUTOMATED RANDOMIZED PATTERN GENERATION USING PRE-DEFINED DESIGN OVERLAYS AND PRODUCTS PRODUCED THEREBY

(75) Inventors: Richard A. Bittner, Etters, PA (US); Steven W. Cox, Chesnee, SC (US); Ronald Magee, LaGrange, GA (US); Jonathan C. McCay, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 1047 days.

(21) Appl. No.: 11/805,031

(22) Filed: May 22, 2007

(65) Prior Publication Data

US 2008/0294272 A1 Nov. 27, 2008

(51) Int. Cl.
*G06F 19/00* (2011.01)

(52) U.S. Cl. ..... 700/131

(58) Field of Classification Search ..... 700/130, 700/131, 133–135; 705/26, 27, 26.1, 27.1, 705/27.2

See application file for complete search history.

(56) References Cited

U.S. PATENT DOCUMENTS

| | | | | |
|---|---|---|---|---|
| 4,019,036 | A | 4/1977 | Hiramatsu et al. | |
| 4,033,154 | A | 7/1977 | Johnson | |
| 4,386,411 | A | 5/1983 | Risk et al. | |
| 4,423,676 | A | 1/1984 | Neel | |
| 4,545,086 | A | 10/1985 | Varner | |
| 5,070,343 | A | 12/1991 | Nakazawa | |
| 5,195,043 | A | 3/1993 | Varner | |
| 5,751,829 | A | 5/1998 | Ringland et al. | |
| 6,509,979 | B2 | 1/2003 | Magee | |
| 6,704,610 | B2 | 3/2004 | West et al. | |
| 6,792,329 | B2 | 9/2004 | Adams et al. | |
| 6,793,309 | B2 | 9/2004 | McCay et al. | |
| 6,854,146 | B2 | 2/2005 | Stoyles et al. | |
| 6,911,245 | B2 | 6/2005 | Beistline et al. | |
| 7,070,846 | B2 | 7/2006 | Beistline et al. | |
| 2003/0139840 | A1 * | 7/2003 | Magee et al. | 700/133 |
| 2005/0106355 | A1 | 5/2005 | Kohlman et al. | |
| 2007/0260352 | A1 | 11/2007 | Magee et al. | |
| 2007/0298209 | A1 * | 12/2007 | Kohlman et al. | 428/95 |

* cited by examiner

*Primary Examiner* — Nathan Durham
(74) *Attorney, Agent, or Firm* — Brenda D. Wentz

(57) ABSTRACT

Provided herein is a process for randomly patterning a plurality of carpet tiles, each tile having a composite pattern containing at least a base pattern and an overlay pattern. When installed, the random order of patterning results in random tile placement and an overall random appearance. The overlay patterns are randomly chosen from a library of patterns until each individual pattern has been used to create a tile series. The overlay patterns may be manipulated by rotating, mirror-imaging, rotating and mirror-imaging, or repositioning to produce additional variations and increase the number of tiles in the series. The base pattern may optionally be manipulated before being incorporated into the composite pattern. A tile collection, containing such randomly ordered composite patterns, is also described.

10 Claims, 12 Drawing Sheets

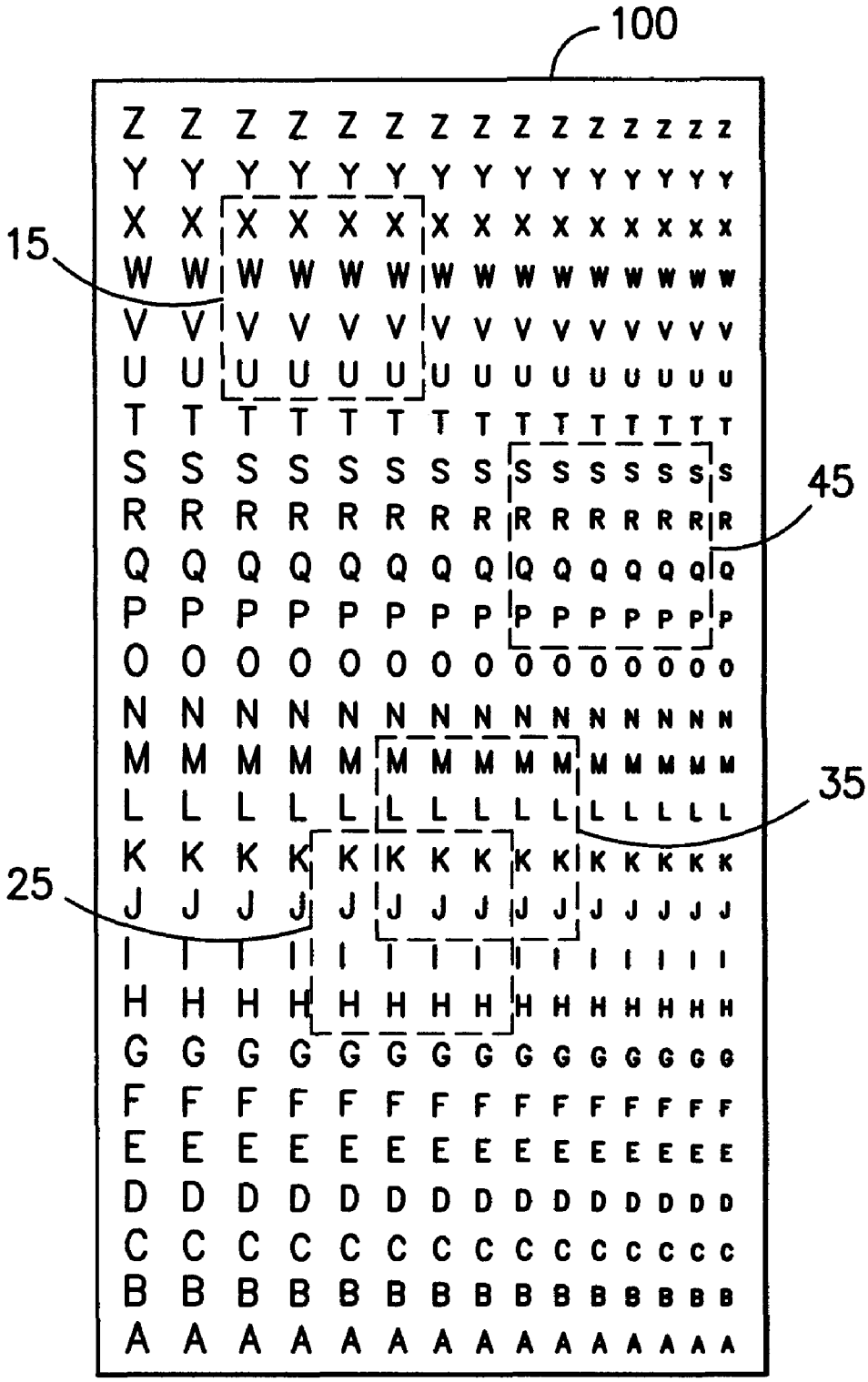
FIG. —4—

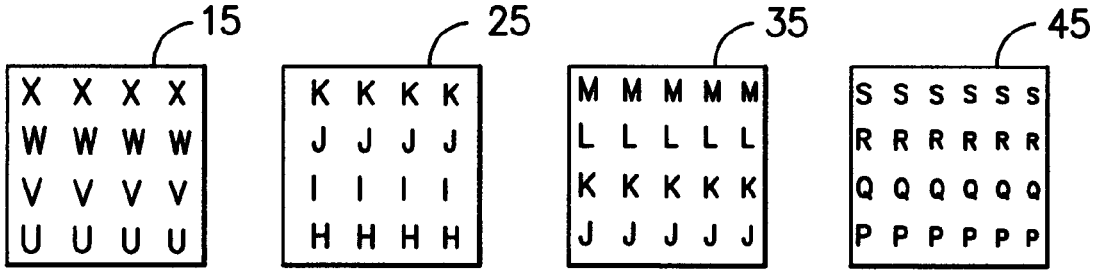
*FIG. –5A–*
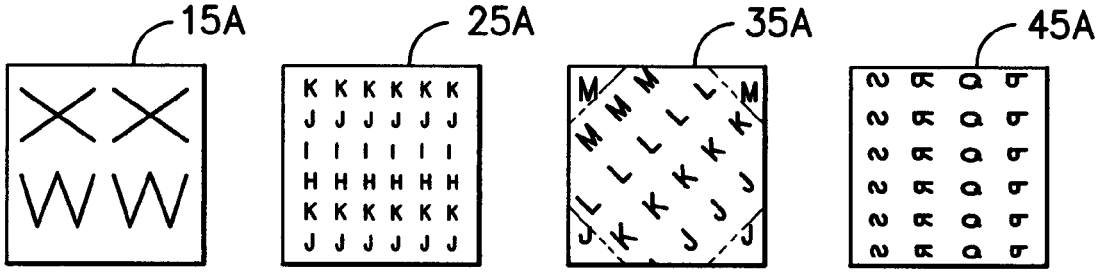
*FIG. –5B–*

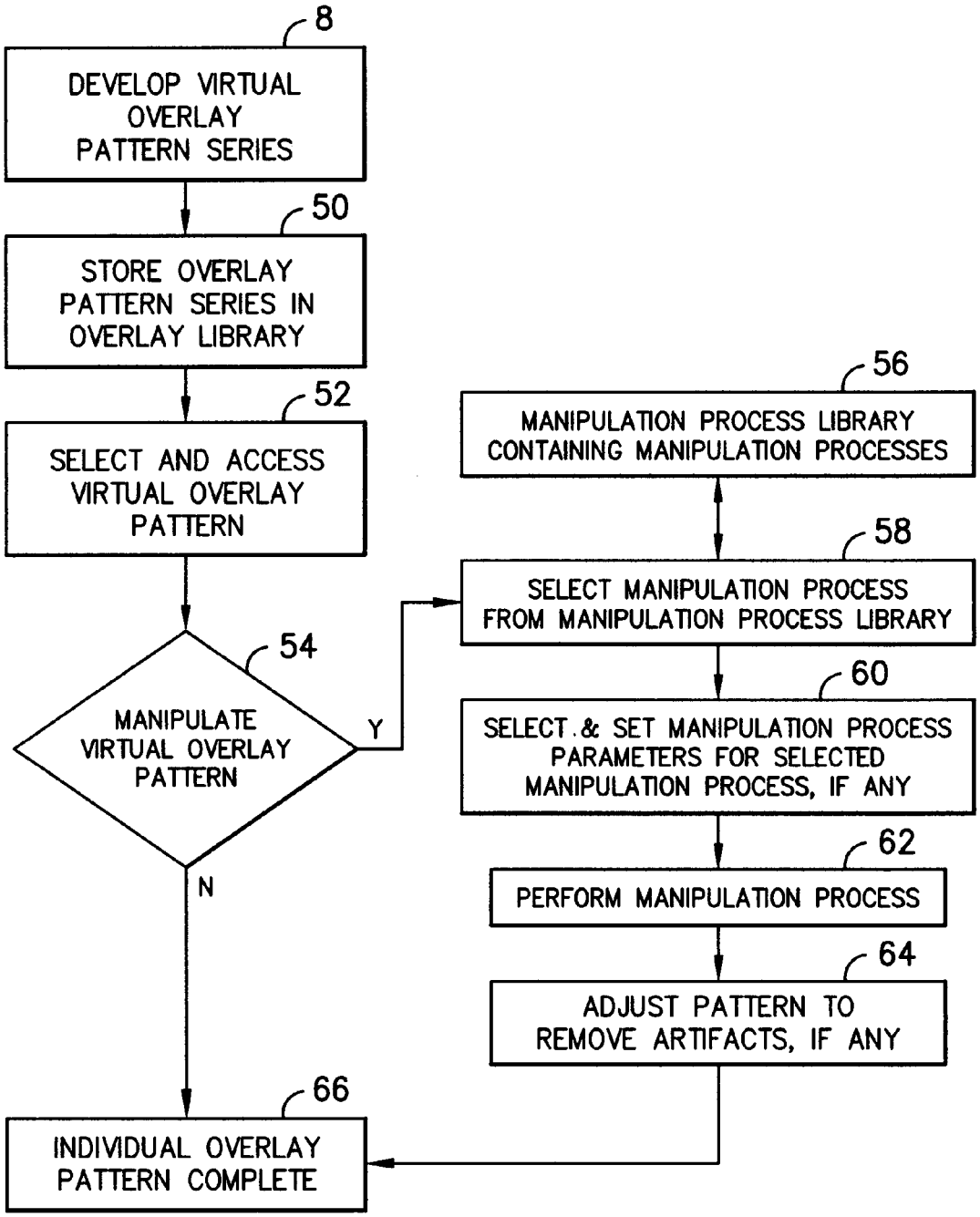
*FIG. –6–*

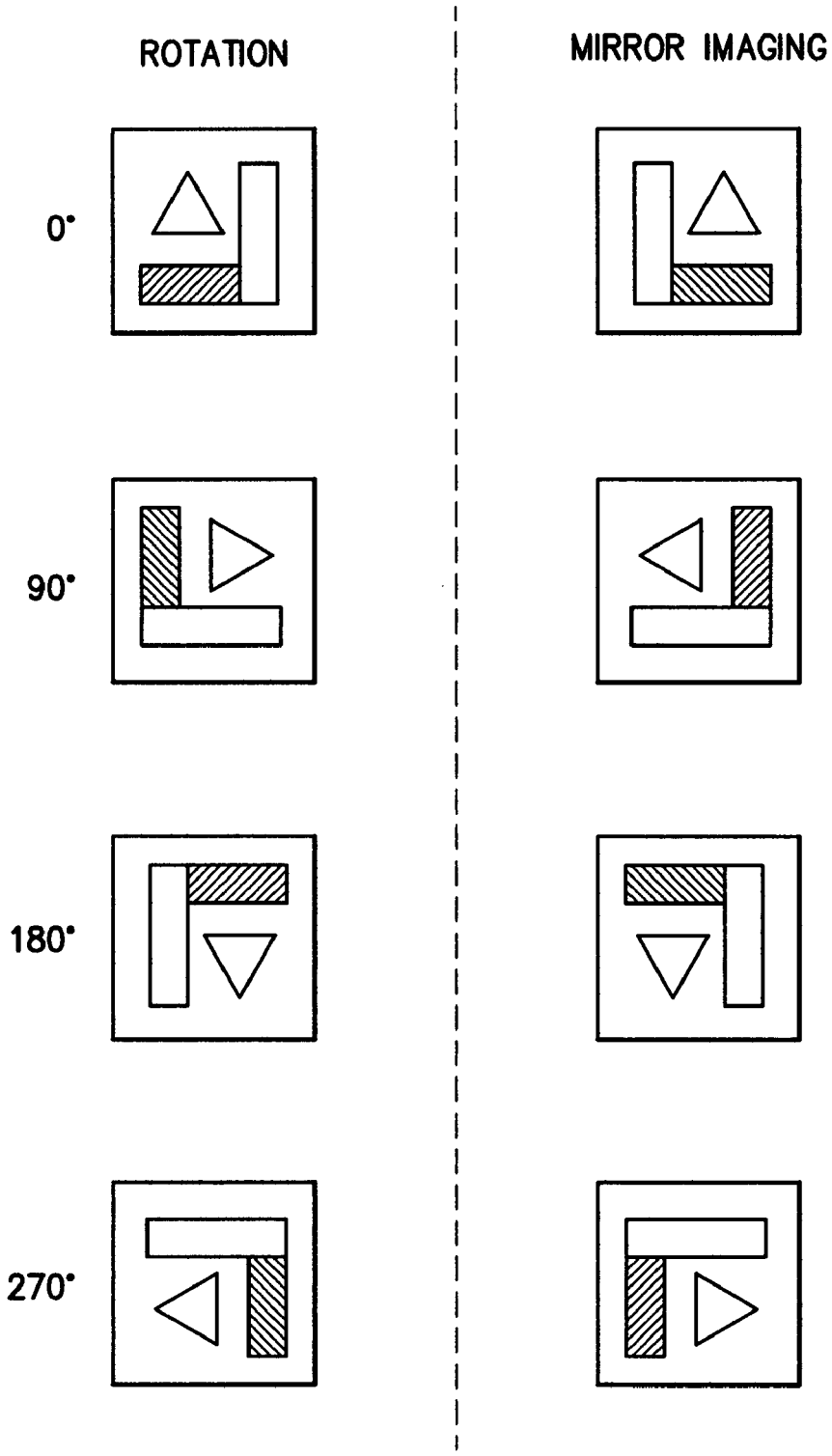
FIG. —7—

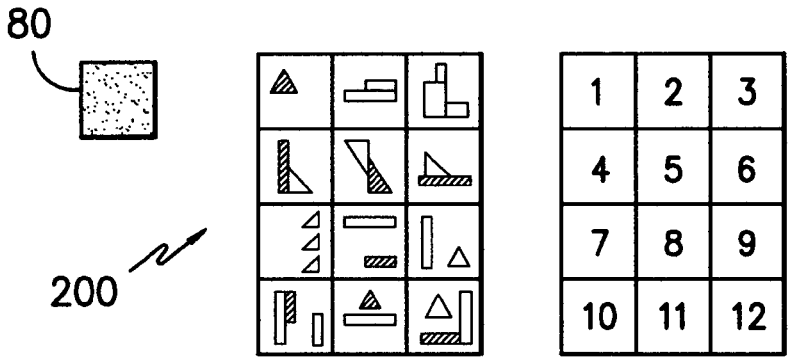
FIG. –8A–
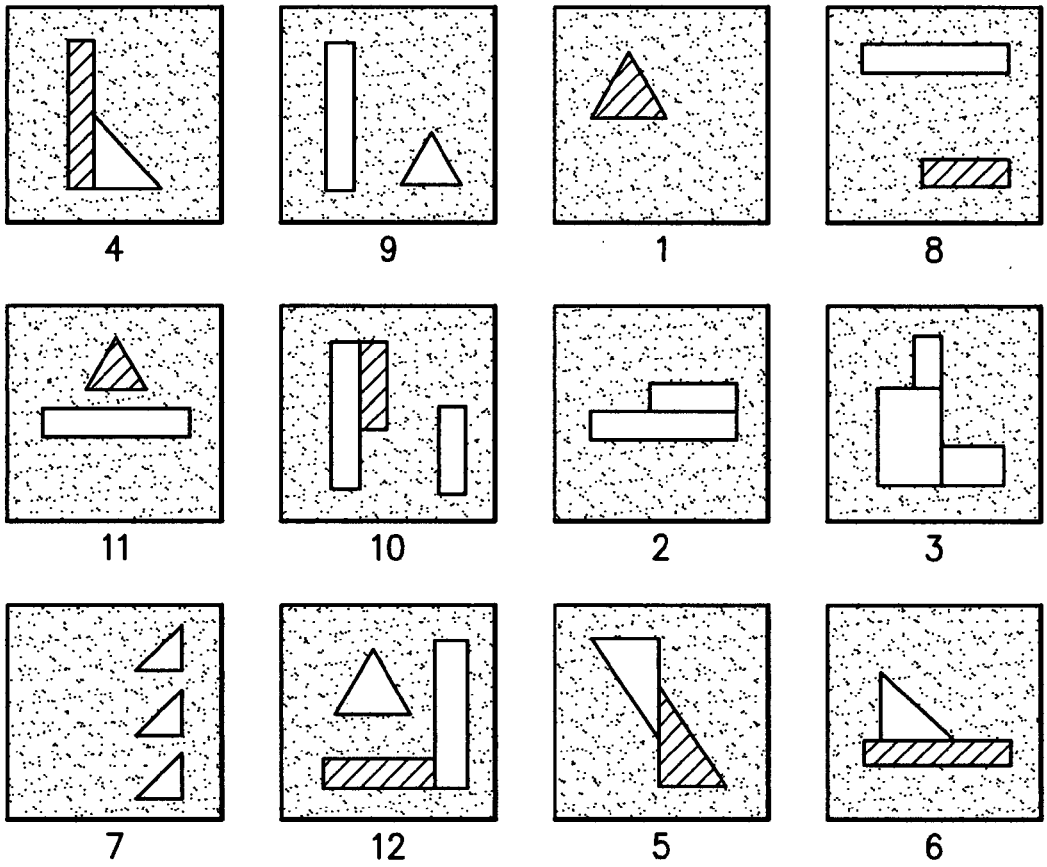
FIG. –8B–

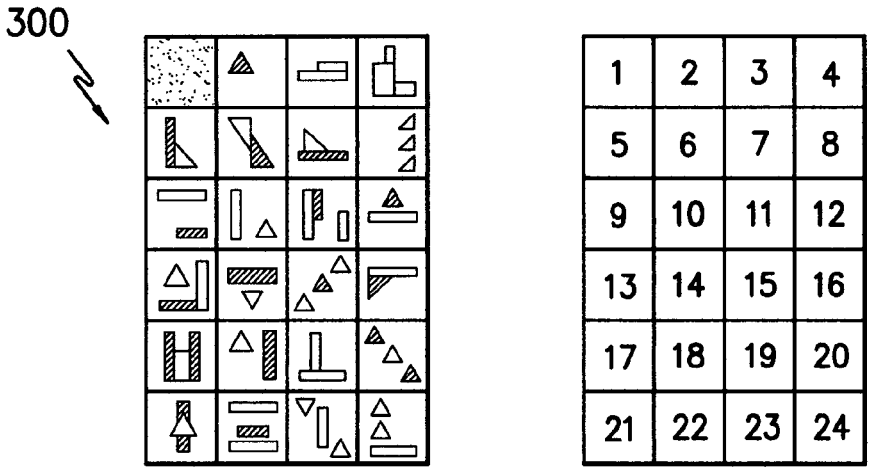
FIG. —9A—
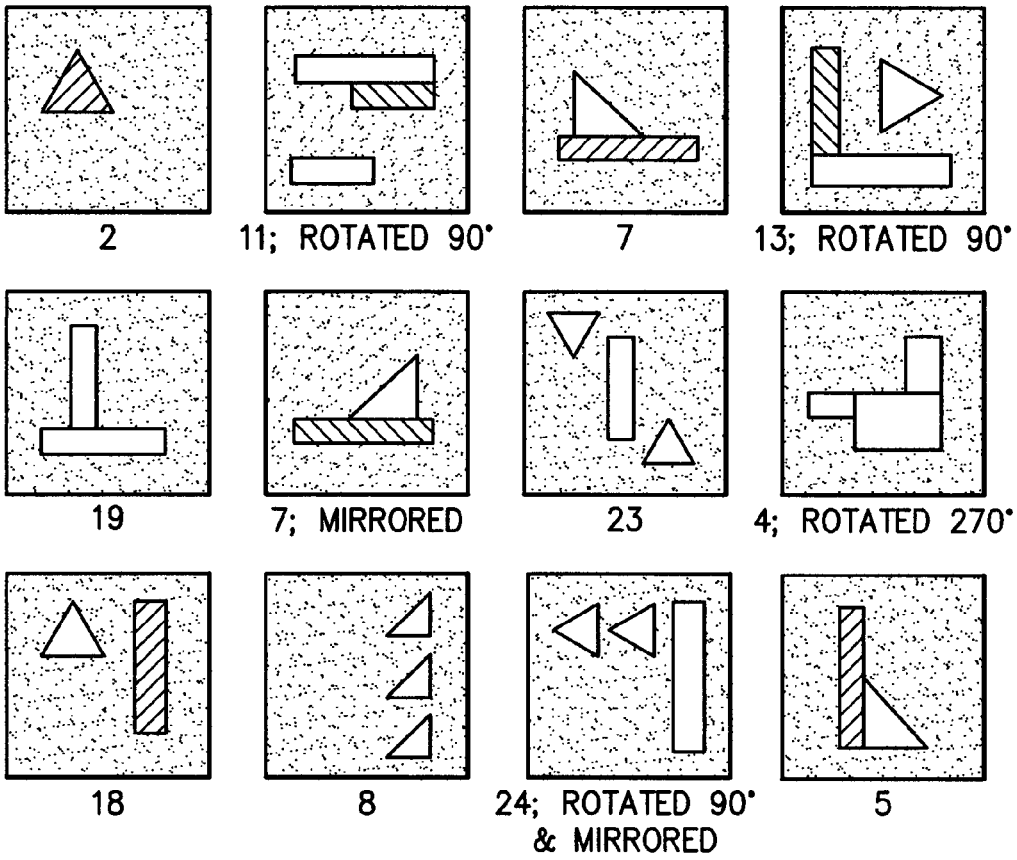
FIG. —9B—

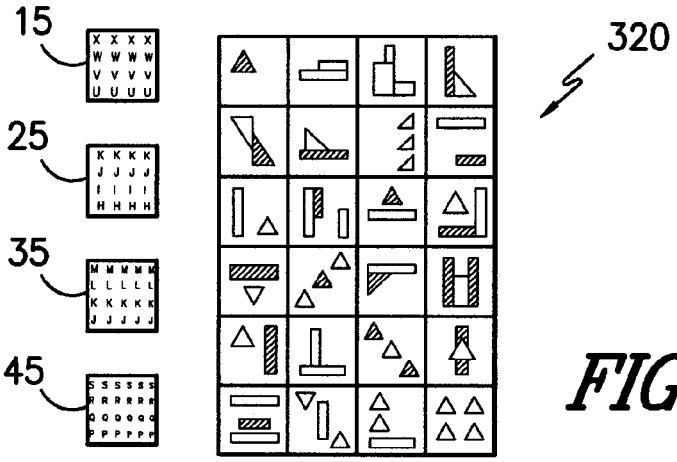
FIG. —10A—
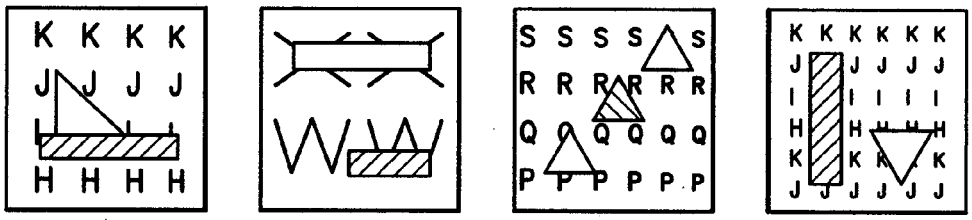
BASE: 25
OVERLAY: 6
BASE: 15A
OVERLAY: 8
BASE: 45
OVERLAY: 14
BASE: 25A
OVERLAY: 17;
ROTATED 180°
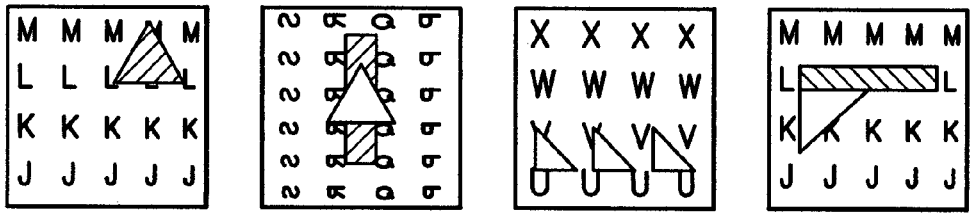
BASE: 35
OVERLAY: 1;
MIRRORED
BASE: 45A
OVERLAY: 20
BASE: 15
OVERLAY: 7;
ROTATED 90°
BASE: 35;
MIRRORED
OVERLAY: 15
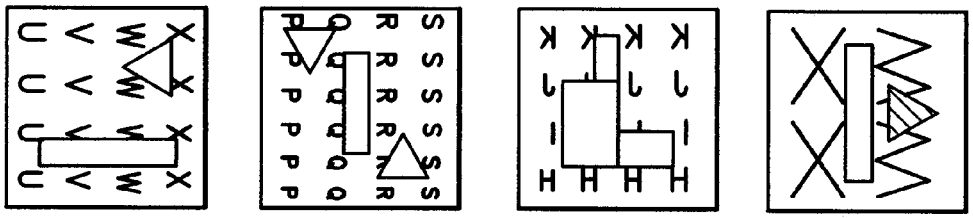
BASE: 15;
ROTATED 90°
OVERLAY: 9;
ROTATED 270°
BASE: 45;
ROTATED 90°
OVERLAY: 22
BASE: 25;
MIRRORED
OVERLAY: 3
BASE: 15A;
ROTATED 270°
OVERLAY: 11;
ROTATED 90°
FIG. —10B—

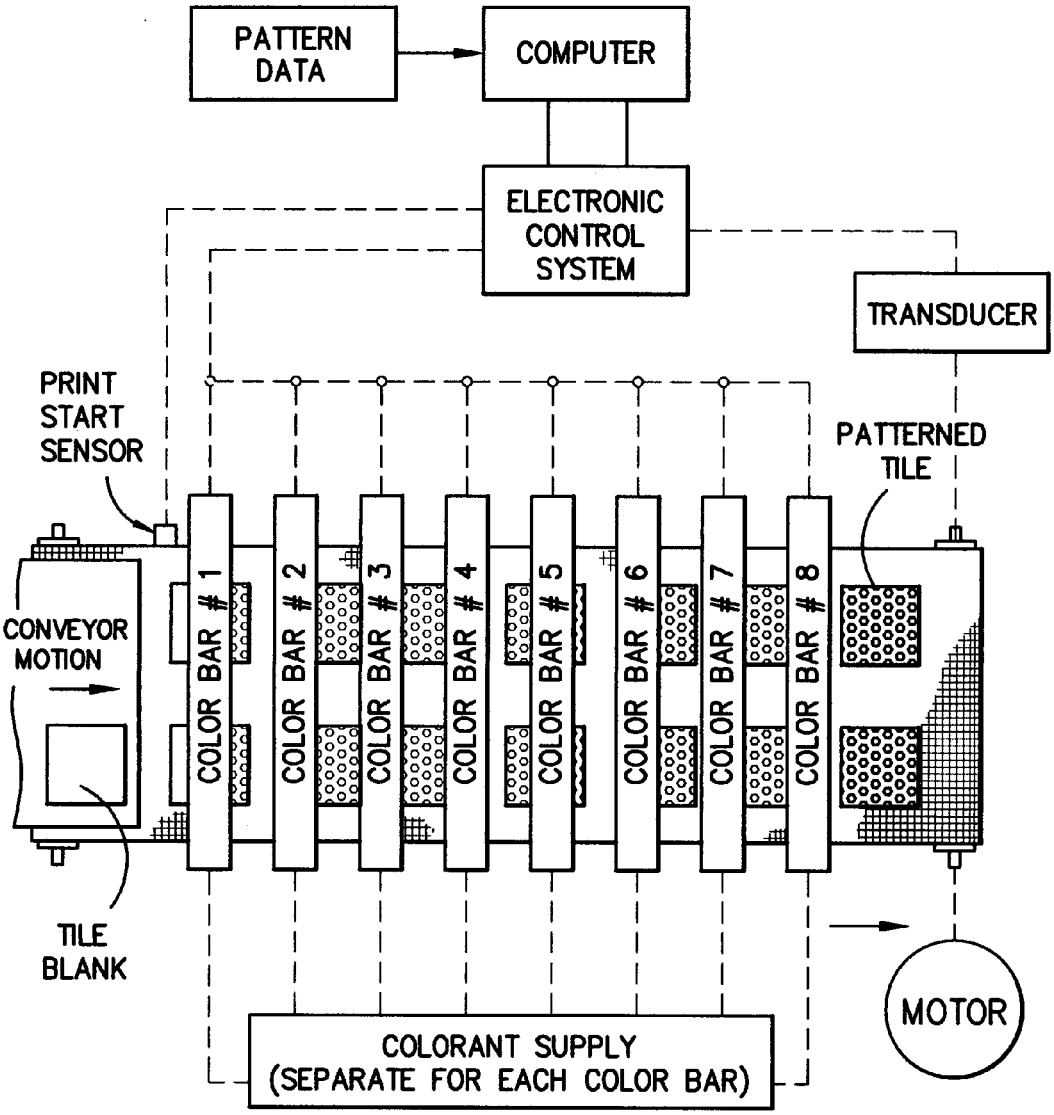
*FIG. –12–*

AUTOMATED RANDOMIZED PATTERN GENERATION USING PRE-DEFINED DESIGN OVERLAYS AND PRODUCTS PRODUCED THEREBY

TECHNICAL FIELD

This disclosure relates to an automated system for generating large numbers of digitally-defined patterns suitable for printing on textiles wherein each pattern shares one or more unifying design motifs with all other patterns. In the general case, each pattern is a composite comprised of at least two components in the form of separate, electronically-defined pattern "layers" that are digitally superimposed. Where a series of such patterns share at least one pattern layer, all patterns in the series will appear visually related to all other patterns in the series. In one embodiment, this patterning system may be used to generate a related series of patterns for use on individual floor tiles or carpet tiles (which, collectively, shall be referred to as carpet tiles), with no two carpet tiles in a series carrying exactly the same composite pattern, yet with all carpet tiles carrying a background pattern or motif, or a series of background patterns or motifs, that serve to unify the overall pattern appearance when such carpet tiles are installed together. In some preferred embodiments, the carpet tiles, when installed, result in a pattern arrangement that appears random. In accordance with the teachings herein, the generation of such patterns can be largely automated and can be carried out as a set of algorithms associated with the patterning machine control system.

BACKGROUND

Floor coverings comprise important interior design elements that are frequently relied upon to unify and enhance a specific interior design concept. Over the last decade, modular carpeting—i.e., the use of carpet tiles or panels—has become a favorite of interior designers, particularly in commercial spaces, due to its potential to mimic the appearance of conventional broadloom carpeting while, at the same time, provide a practical means by which localized portions of the carpeting can be easily removed to access under-floor wiring or can be easily replaced in the event of damage, excessive wear, staining, and the like. One specific application of the techniques disclosed herein is to automate the creation of a large number of individual carpet tiles that, when installed, produce a non-repeating, multiple-tile pattern sufficient to generate high visual interest and that disguise, to a large degree, any patterning artifacts that would otherwise be visually objectionable, yet provide one or more common design elements that visually unify the multiple tile pattern.

One of the generally acknowledged key attributes of a successful modular carpet tile installation, and one that may be helpful in achieving the look of broadloom carpet, is the inconspicuousness of the seams between contiguous carpet tiles. Where design elements within a single tile are duplicated in adjacent tiles and/or extend into adjacent tiles, and those design elements are not perfectly duplicated within each tile, the region around the seam can become visually obtrusive due to pattern discontinuities between adjacent tiles and can draw attention to any imperfections in the form of mismatched color or misaligned design elements. This condition, which shall be referred to as "seam discontinuity," occurs frequently when there are design elements—for example, a simple band of color—that extend across the boundary separating adjacent tiles and that tend to emphasize the transition from one tile to a contiguous tile. Somewhat counter-intuitively, one way to make such transitions as unobtrusive as possible is to apply a pattern to the individual carpet tiles that provides such visual variety across the installation as a whole that the transition between individual adjacent tiles becomes relatively less important. To the viewer, the non-regular nature of the overall pattern formed by multiple tiles visually overwhelms the discontinuities at the boundaries, with each tile in a series (but not necessarily in a collection, or installation) having a unique pattern but one that is aesthetically consistent, in terms of color and individual pattern elements, with all other tiles in the installation. Another key attribute of a successful modular carpet installation, or any carpet installation, for that matter, is the ability of the selected pattern to provide an unobtrusive complement to the overall interior design. Floor covering patterns are frequently based on a relatively small pattern, i.e., one in which at least one complete pattern repeat may be defined completely within the area of a single carpet tile. Such patterns, however, carry a significant potential disadvantage. In many cases, otherwise well-placed design elements appear to align into rows when viewed along relatively shallow viewing angles, resulting in large-scale pattern anomalies that involve multiple carpet tiles and that extend over large areas of installed carpet. Such pattern anomalies (which are sometimes referred to as "design lines") can be sufficiently severe as to become visually prominent and overwhelm the intended overall pattern.

Added to such inherent design-based problems is the fact that the patterning process can occasionally cause slight periodic non-uniformities to occur within the pattern, such as the uneven application of dye within a pattern element or background area, resulting in a localized streak or band. When viewed as individual tiles, such periodic non-uniformities can be relatively unobtrusive, but when a series of such tiles carrying the same non-uniformity are installed over a larger area, such non-uniformities can become aligned, thereby emphasizing these manufacturing artifacts and forming visually conspicuous streaks or bands that extend over many carpet tiles. For purposes herein, these pattern anomalies, design lines, and manufacturing artifacts shall be collectively referred to as "patterning artifacts."

It is believed that both seam discontinuities and patterning artifacts can be emphasized by the incorrect choice of the size of the pattern repeat, coupled with a subconscious expectation of uniformity or symmetry that is generated by seeing a relatively large expanse of carpet tiles, all having the same pattern. Accordingly, in order to minimize or eliminate such discontinuities and artifacts, the use of a non-repeating design, but one which shares common colors and design elements among adjacent tiles, has been found to be effective in eliminating the subconscious expectation of uniformity or symmetry, thereby minimizing the visual impact of patterning artifacts as well as seam discontinuities.

A challenge in implementing this technique is developing a system by which a series of such composite patterns can be generated and printed at the time of manufacture. It is possible to achieve a pseudo-random appearance using a relatively small number of different design elements on individual carpet tiles, and then rotating the tiles during installation to produce a more random-appearing overall pattern. However, because this involves turning the tiles to orient them in different directions during installation, the pile orientation of the individual tiles is also turned, which may result in a variety of problems, including watermarking or sheen (difference in light reflectivity from tile to tile) and seam problems (dramatic pile lay changes at boundaries). Accordingly, the techniques disclosed herein are believed superior, as these problems are generally avoided.

At least one of the techniques described herein provides a series of carpet tiles, each of which carries a unique pattern that is pre-defined, using design elements that preferably coordinate with a base layer and with other patterns in the series. Optionally, the orientation of the overlay pattern may also be altered before printing on the carpet tile, thereby introducing a greater number of unique composite patterns while allowing for an installation that preserves a single direction for pile lay (i.e., a "unidirectional" installation). Additionally, this technique allows for certain geometric operations to be performed on the pattern to enhance the appearance of pattern randomness, if desired.

As an additional advantage of the pattern generation system disclosed herein, in at least one embodiment, at least one common design element or motif (for example, the background) is incorporated into the composite pattern to serve as a visually unifying element across all tiles in the installation. Accordingly, the composite patterns generated in accordance with the teachings herein and carried by the carpet tiles exhibit a distinct "random" or "pseudo-random" appearance when installed, although these patterns have at least one integrating design motif that is coordinated across all generated patterns, thus imparting an underlying visual uniformity to the carpet tile installation. As an additional benefit, the random or pseudo-random elements incorporated into the design tend to mask any visually obtrusive, large-scale design lines that can appear as the unintended artifacts of the design or manufacturing process, as well as any unintended mis-matching of patterns or colors at the boundaries of the individual tiles.

By use of the design systems described herein, the designer has at his or her disposal automated techniques that, with minimal designer input, can generate a series of patterns that share a common artistic theme or motif and that are suitable for use in patterning carpet tiles or other floor coverings, as well as other textile products. In particular, the systems disclosed herein are especially suited for use in patterning carpet tiles or other textiles using the application of interruptible dye streams and electronically-controlled dye applicators that are actuated in accordance with digitally-defined patterns. In such applications in which electronically-defined patterns are accessed and processed as part of the patterning process, the system disclosed herein effectively re-locates a portion of the design process to the actual patterning step in the manufacturing process, where it can proceed without designer intervention.

While the techniques and systems described herein are especially well-suited for printing or dyeing carpet tiles, it is contemplated that similar designs may be computer generated using pre-dyed yarns on graphic tufted machines.

Definitions

To facilitate the discussion that follows, the explanations will assume that the substrates to be patterned are carpet tiles of uniform size, but not necessarily of uniform pile height. It should be understood, however, that the concepts may be applied to patterning other substrates, and particularly other textile substrates (including broadloom carpets), with appropriate modifications with respect to the size and nature of the substrate and the pattern effect to be desired. Additionally, it should be understood that the following terms shall have the meanings indicated below, unless the context clearly dictates otherwise. These definitions will serve as an introduction to some of the concepts explained in more detail further below.

The term "layer" refers to a separately configurable virtual data space which stores a pattern or design that is intended to be superimposed upon (or be superimposed by) other patterns or designs (each of which would constitute a separate layer) to form a composite pattern. The pattern for each layer is capable of being independently selected and, optionally, independently oriented (that is, rotated or mirrored). For example, a first layer could be comprised of a set of spaced vertical parallel lines and a second layer could be comprised of a pattern of geometric shapes. Inhabiting separate data files within the design software, the first layer, for example, may act as the background layer, while the second layer's geometric shapes could be positioned over the background stripes as the superimposed layer to form a new composite pattern. Optionally, the superimposed pattern may be rotated (for example, 90 degrees), mirror-imaged, rotated and mirror-imaged, or repositioned (that is, "translated"), to create additional composite patterns. Also optionally, the background layer may similarly be geometrically altered (for example, by rotating, mirror-imaging, etc.).

As used herein, one layer—the background layer—will be referred to as the "base" layer (which is comprised of the base pattern, as defined below), and all other layers—the superimposed layers—will be referred to as "overlay" layers (comprised of one or more overlay patterns, as defined below), although this nomenclature does not necessarily imply any specific number of layers or any order in which the layers are placed on the substrate. In fact, as contemplated herein, these terms are merely used to describe the pattern generation process, and not the process or sequence through which the pattern is actually applied to the substrate. This distinction may be important in certain printing operations where, for example, the application of yellow and blue in the same area of the substrate, in that order, yields a different shade of green than the corresponding application of blue and yellow, due to "masking," dye saturation, and other effects. Typically, it is believed the designer will choose the base layer to be that layer that most nearly covers the surface of the substrate to be patterned and onto which one or more overlay patterns are applied, in order to maximize the visually unifying aspect of the base layer, but this is not required by the processes described herein.

The term "host" refers to a master pattern, preferably in virtual form and preferably non-repeating in nature, from which small, template-sized pattern subsets or samples may be defined. If applied to a floor covering context, in one embodiment the host could be thought of as a non-repeating pattern on a virtual large substrate (say, for example, a virtual substrate dimensioned to be twenty feet square), onto which may be superimposed a tile-sized virtual template (for example, eighteen or thirty-six inches square) at various locations randomly (or non-randomly) positioned within the large virtual substrate. At each position, the template defines a tile-sized pattern "sample" of the master host. If the host pattern is non-repeating and sufficiently large, and each template position within the host is unique (i.e., the template position is not exactly repeated within a given tile series), then every host pattern sample defined by the template for a given tile series will also be unique. Conversely, if the position of the template within the host is repeated, then the resulting host pattern sample will also be repeated. In one embodiment, hosts may be used to define infinite, unique base patterns. Alternately, the position of the template within the host may be repeated to produce composite patterns having the same base pattern for all tiles in the series. In yet another embodiment, the position of the template within the host may be repeated, but the host pattern sample may subsequently be manipulated (e.g., by rotating, mirror imaging, stretching, shrinking and repeating, etc.) before being incorporated into the composite pattern, thereby defining unique, but related, base pattern layers.

The term "template" refers to a closed geometric shape that defines the borders of the pattern sample to be extracted from the host pattern to form a base pattern. The template may be any shape or size, depending upon the desired design effect, although templates having the dimensions of the tile to be printed are most often contemplated herein. It is also contemplated (but not required) that separate templates may be defined for use as base layers.

The term "base layer pattern" or "base pattern" refers to a pattern layer that acts as the background onto which design overlays are superimposed. In one embodiment described herein, the base pattern remains consistent for all of the tiles in a given collection. Alternately, the base pattern may be manipulated before being digitally combined with the overlay pattern to form a composite pattern. It is contemplated, in one embodiment, that the base layer host pattern will be sized to match, or nearly match, the size of the substrate to be patterned (e.g., a 36-inch square for patterning a 36-inch carpet tile), and the base pattern template will simply be the same size as the base layer host pattern. This means that, in this embodiment, every base pattern will be identical—the same pattern element(s) expressed in the same location(s)—for each composite pattern, and therefore every composite pattern will have the same unifying design element(s) in the same location(s), whereas the overlay pattern will vary for each composite pattern within the design series.

In yet another embodiment contemplated herein, each base pattern is selected from a host pattern using a template (the "base pattern template"), such that the base patterns of a collection of tiles are unique but related by the same design motifs and elements. In this instance, unique base patterns are individually printed on a single substrate (e.g., a single carpet tile), resulting in a series of printed substrates that are uniquely patterned (although all substrates will share whatever design similarities that exist within the host pattern that was used, after any pattern manipulation is accounted for).

As made clear above, an objective of the processes disclosed herein is the automated generation of a series of patterns to be randomly placed on a respective series of carpet tiles, with the resulting carpet tiles exhibiting a random or pseudo-random pattern when installed, but also exhibiting one or more unifying pattern elements (typically, from the base pattern host) that visually integrate the various tiles and provide overall pattern coherence to the floor covering installation. To facilitate the discussion below, it will be assumed that the random or pseudo-random component of the composite pattern is assigned to one or more overlay patterns, and the unifying pattern elements are assigned to the base pattern layers, either of which may be manipulated before being combined into composite patterns.

A primary purpose of the base pattern is to provide common pattern elements or colors that are shared by all carpet tiles (or at least the suggestion of such elements or colors), thereby providing a unifying pattern motif across multiple carpet tiles that may carry dramatically different overlay patterns and thereby form a visually integrated or coherent interior space despite the "random" appearance of the overall pattern when installed. In one embodiment, the base pattern host is larger than the base pattern template and can, through varying the placement of the template at different locations within the host and/or the geometric manipulation (e.g., rotating, mirror-imagining, etc.) of the resulting host "sample", generate base patterns that are themselves unique. It is also contemplated that, where the base pattern template is not larger than the base pattern host, the template can be positioned at the same location within the host, thereby generating a repeating pattern that can be placed at different locations within the composite pattern.

The term "overlay pattern" refers to a pattern layer, separate from the base pattern layer, which is selected from a collection of pre-defined overlay patterns ("the overlay pattern collection"). The overlay pattern collection is a set of pre-defined patterns that visually coordinate with a particular base pattern and with other overlay patterns within the set. In one embodiment, each overlay pattern in a tile series incorporates design elements and colors of the base pattern, with no two overlay patterns in a series being identical. In the embodiments described herein, it will be assumed (as a simplifying, non-limiting example) that all of the overlay patterns from a particular overlay pattern collection (including desired manipulations to the overlay patterns) are printed in random order to create a first tile series before randomized printing of the overlay patterns (and their desired manipulations) begins again to create subsequent tile series. While it is contemplated that multiple overlay layers may be used on a single tile, with each layer representing a different pattern from the series, it is anticipated that, in many cases, a single overlay layer will be sufficient, if the corresponding pattern series available for use as an overlay layer is sufficiently varied.

Among the design elements contemplated for use as overlay pattern components are letters, words, trademarks, logos (for instance, commercial or school logos), and the like, which may be proprietary to the users of such patterned carpet tiles. In instances where such proprietary design elements are used, the manipulation algorithms described herein are modified to prevent the design element (e.g., the logo) from being mirror-imaged, or otherwise distorted, or from being truncated by being placed too close to a tile edge. Thus, the integrity of the proprietary design element is preserved.

The term "composite pattern" refers to the superposition of a base pattern and at least one overlay pattern, as created prior to any actual patterning step.

The term "tile series" refers to a plurality of tiles, each of which has been printed with a base pattern and one of the pre-defined overlay patterns from the overlay pattern collection. The tile series contains at least the same number of tiles as there are overlay patterns (that is, if there are twelve unique overlay patterns, then the tile series has a minimum of twelve tiles). If each of the twelve unique overlay patterns is manipulated, for example, in one of eight ways, as will be discussed further herein, then the tile series may contain 96 tiles. Using computer algorithms, the order in which the tiles within a tile series are printed varies from one tile series to the next, creating a random order for printing and installation. It should be understood that where the base pattern is randomly selected from a much larger base pattern host, thereby resulting in unique base pattern layers, the tile series may be, as a practical matter, infinitely large, particularly if the base pattern is subject to geometric manipulation prior to printing.

The term "tile collection" refers to sets of tiles that share a unifying base pattern, but that have overlay layers that are derived from a given tile series intended for use with that base pattern. Because the tiles in each tile series are produced with overlay patterns that are randomly ordered, the tile collection will similarly contain tiles whose patterns are randomly ordered. In at least one embodiment, it is potentially preferred that the tiles of a collection are installed so that no two identical tiles are positioned adjacent to one another, in the same row with one another, in the same column with one another, in the same diagonal with one another, or the like, to maintain the random appearance of the installation.

The term "geometrically manipulated" or "geometric manipulation" refers to processes of altering the appearance of a pattern by techniques such as rotating, mirror-imaging (either along an edge or some selected axis), rotating and mirror-imaging, re-scaling (that is, expansions or contractions of all or portions of a pattern), shifting or translating (that is, moving a design element from one location to another), and the use of more complex, multi-step techniques. In the case of overlay patterns, the preferred manipulation steps are rotation (preferably in 90-degree increments), mirror-imaging along an edge, rotation and mirror-imaging, and translating. In terms of multi-step techniques, which are typically more suitable for use with base patterns, multiple patterns may be extracted, or otherwise generated, either from the original extracted pattern or in combination with one or more other pattern(s) extracted from the host pattern. In the latter case, where multiple patterns are to be used, the various patterns may be electronically "stitched," collaged, or otherwise combined to form a pattern that is aesthetically pleasing for use on the face of the carpet tile.

SUMMARY

Provided herein is a process for randomly patterning a textile substrate, or a plurality of textile substrates—for example, carpet tiles—in which each tile has a composite pattern containing at least a base pattern and an overlay pattern. When installed, the random order of patterning results in random tile placement and an overall random appearance. The overlay patterns are randomly chosen from a library of patterns until each individual pattern has been used to create a tile series. The overlay patterns may be manipulated by rotating, mirror-imaging, rotating and mirror-imaging, and/or changing their position on the tile (by translating the position of the template) to produce additional variations and increase the number of tiles in the series that are chosen before the series begins to repeat. The base pattern optionally may be manipulated before being incorporated into the composite pattern. A tile collection containing such randomly ordered patterns is also described.

In a first embodiment, the base pattern host is the same size as the base pattern template, thereby ensuring that the base pattern is the same for all of the tiles of a collection. Alternately, the base pattern layer may be manipulated before combination into the composite pattern, increasing the number of different composite patterns that may be produced. In both such cases, an aesthetically appropriate overlay pattern is selected randomly, preferably using a computer algorithm, from a series of different pre-designed and coordinating overlay patterns. Each pattern in the series is produced by randomly selecting one of the overlay patterns for combination with a base pattern, superimposing the selected overlay pattern onto the base pattern to form a composite pattern, and then applying the composite pattern to sequential carpet tiles during the manufacturing process. This process, including the selection of overlay patterns in random order, is repeated, as necessary, until composite patterns having each of the overlay patterns are created. If necessary, the process of random selection of overlay layers for combination into composite patterns is repeated until a collection having the desired number of tiles is created.

In a second embodiment, a base pattern host is the same size as the base pattern template, thereby ensuring that the base pattern is the same for all of the tiles of a collection. An aesthetically pleasing overlay pattern is selected randomly, preferably using a computer algorithm, from a series of different pre-designed and coordinating overlay patterns. In this embodiment, the selected overlay pattern is manipulated by changing the pattern's geometric orientation (e.g., by rotating it, mirroring it, rotating and mirroring it) or changing its position on the tile (e.g., geometric translation), thus increasing the potential number of overlay patterns that may be used in the series. Again, each pattern in the series is produced by randomly selecting one of the overlay patterns (or one of its manipulated versions) for combination with a base pattern, superimposing the selected overlay pattern or its manipulated version onto the base pattern to form a composite pattern, and then applying the composite pattern to sequential carpet tiles during the manufacturing process. This process, including the selection of overlay patterns (and their manipulated versions) in random order, is repeated, as necessary, until composite patterns having each of the overlay patterns (and their manipulated versions) are created. If necessary, the process of random selection of overlay layers for combination into composite patterns is repeated until a collection having the desired number of tiles is created.

In a third embodiment, a base pattern host is larger than the base pattern template, thereby virtually ensuring that the base pattern is different for all of the tiles of a collection. Because the base pattern host is significantly larger than the base pattern template, a considerably larger number of base patterns may be created, particularly if the base pattern is geometrically manipulated before being combined into the composite pattern. The overlay pattern is chosen randomly, preferably using a computer algorithm, from a series of different pre-designed and coordinating overlay patterns. In this embodiment, the overlay pattern optionally may be geometrically manipulated by changing the pattern's orientation by rotating it, mirroring it, rotating and mirroring it, or by changing its position on the tile, thus increasing the number of overlay patterns that may be used in the series. Each pattern in the series is produced by randomly selecting one of the overlay patterns (or one of its manipulated versions) for combination with a base pattern (randomly selected from the base pattern host), superimposing the selected overlay pattern onto the selected base pattern to form a composite pattern, and then applying the composite pattern to sequential carpet tiles during the manufacturing process. This process, including the selection of overlay patterns (and their manipulated versions) in random order, is repeated, as necessary, until composite patterns having each of the overlay patterns (and their manipulated versions) are created. If necessary, the process of random selection of overlay layers (and their manipulated versions) for combination into composite patterns is repeated until a collection having the desired number of tiles is created.

This disclosure can be best understood when read in conjunction with the accompanying drawings, as briefly described below.

BRIEF DESCRIPTION OF THE DRAWINGS

FIG. 4 schematically depicts the placement of a base pattern template (see dashed lines) at four arbitrary locations within the base layer host pattern 100 of FIG. 2. The dashed lines define four base patterns 15, 25, 35, and 45 to be extracted from this host. Because there is no pattern repeat contained within the host pattern, every placement of the template at a unique location within the host pattern will yield a unique base pattern. In an alternate embodiment, a base pattern template positioned at a single location within the base host pattern may be used as the base pattern for all tiles within a tile series or collection.

FIG. 5A depicts the four base patterns 15, 25, 35, and 45 extracted from the base host of FIG. 4 prior to any optional pattern manipulation (e.g., re-scaling, mirror imaging, lateral or vertical "flipping", rotating the design, etc.) to further expand the range of patterns that can be produced using the processes disclosed herein. These base patterns can be used sequentially "as is" to form a base layer, or, optionally, can be first subjected to one or more pattern manipulation steps.

FIG. 5B depicts the four base patterns of FIG. 5A following exemplary pattern manipulation. Host pattern 15 has been cropped and stretched horizontally, host pattern 25 has been reduced in size, with pattern lines repeated to fill in the template space, host pattern 35 has been rotated 45 degrees and superimposed upon itself, and host pattern 45 has been mirror-imaged and rotated 90 degrees. As depicted at 15A, 25A, 35A, and 45A, the resulting patterns are shown as they would appear as patterns for use in a base layer.

FIG. 6 is a flow diagram similar to FIG. 1, describing, in summary fashion, exemplary sub-processes useful in generating an overlay pattern with optional pattern manipulation.

FIG. 7 schematically depicts an overlay pattern stored in digital form and used as part of the process depicted in FIG. 6. As shown in FIG. 7, the virtual overlay pattern may be geometrically manipulated, either manually or preferably using a computer logarithm, as, for example, by rotation (as shown top to bottom on the left side of the figure) or by mirror imaging of the original or rotated images (as shown top to bottom on the right side of the figure). While other manipulation processes, as will be described herein, may alternately be used, rotation at 90-degree angles and mirror imaging may be preferred techniques for modifying an overlay pattern for most carpet tile installations.

FIG. 8A schematically depicts a 3×4 array 200 of predefined overlay patterns for use with a single base pattern 80, which optionally may be manipulated before being combined to form a composite pattern.

FIG. 8B schematically depicts a tile series produced from the base pattern 80 and the overlay patterns of FIG. 8A. Each of the unique overlay patterns shown in array 200 is superimposed on the base pattern 80 to form a tile series having 12 unique composite patterns. It should be understood that, for the sake of illustration, only 12 overlay patterns are shown, and that the 12 overlay patterns are arranged in a 3×4 grid, although other numbers of overlay patterns may be used and such patterns may be arranged in any workable configuration, depending on the computer software being used. For discussion purposes, a 3×4 array numbered 1 through 12 is also provided.

FIG. 9A schematically depicts a 4×6 array 300 of predefined overlay patterns for use with a single base pattern 80 (from FIG. 8A), which optionally may be manipulated before being combined to form a composite pattern. In this embodiment, the base pattern 80 is positioned in square 1 of the 4×6 array. It should be understood that, for the sake of illustration, only 23 overlay patterns are shown, and that the 23 overlay patterns are arranged in a 4×6 grid with the base pattern, although other numbers of overlay patterns may be used and such patterns may be arranged in any workable configuration, depending on the computer software being used. For discussion purposes, a 4×6 array numbered 1 through 24 is also provided. Each of the unique overlay patterns shown in array 300 may be manipulated, as represented in FIG. 7, before being superimposed on the base pattern 80. The resulting tile series contains tiles having one of a minimum of 184 unique overlay patterns (23 overlay patterns multiplied by 8 different orientations). To increase the random appearance of the installation, additional manipulations may be used, the number of overlay patterns may be increased, and/or the number of overlay patterns used may be increased.

FIG. 9B schematically depicts representative tiles from a tile series produced from the base pattern 80 and overlay patterns of FIG. 9A, some of which have been geometrically manipulated.

FIG. 10A schematically depicts a 4×6 array 320 of predefined overlay patterns for use with multiple base patterns 15, 25, 35, 45 (from FIG. 5A), any of which may be combined to form a plurality of composite patterns. Each of the unique overlay patterns shown in array 320 may be manipulated, as shown in FIG. 7, before being superimposed on the base pattern 80. Further, any of the base patterns may also, or instead, be manipulated. The resulting tile series contains tiles having one of a minimum of 192 unique overlay patterns, although the number of different composite patterns may be considerably larger if both the base layer and the overlay layer are separately manipulated. As a result, two tile series within the same collection may each have composite patterns unique to it. It should be understood that, for the sake of illustration, only 24 overlay patterns are shown, and that the 24 overlay patterns are arranged with the base pattern in a 4×6 grid, although other numbers of overlay patterns may be used and such patterns may be arranged in any workable configuration, depending on the computer software being used.

FIG. 10B schematically depicts representative tiles from a tile series produced from base patterns 15, 25, 35, and 45 (from FIG. 5A) and the overlay patterns of FIG. 10A, some of which have been geometrically manipulated.

FIG. 12 schematically depicts a patterning machine, suitable for use in connection with the pattern generation system disclosed herein, in which electronically defined patterns can be generated and printed onto the surface of a moving textile substrate of the kind contemplated herein.

DETAILED DESCRIPTION

Overview

Figure 1:
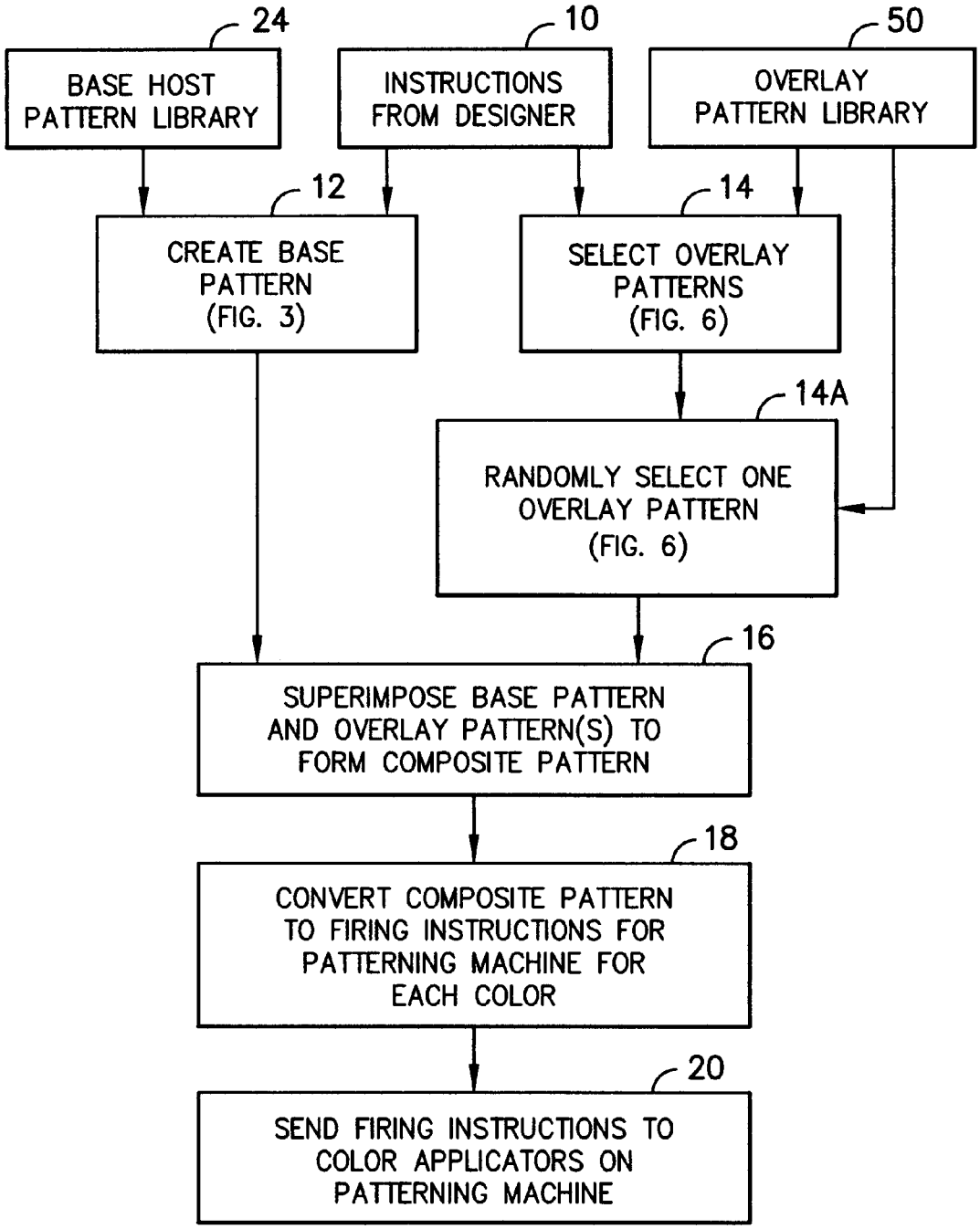
FIG. 1 is a flow diagram that presents an overview of the processes described herein in the form of high level process steps useful in generating the composite patterns described herein, including the pattern formation steps described in more detail in FIGS. 3 and 6.

FIG. 1 presents a simplified overview of the interaction among selected sub-processes, some of which are described in greater detail below, that comprise the disclosed design process in which a series of base patterns and one or more overlay patterns are combined to form a series of composite patterns that are non-repeating, yet carry one or more common design elements. Pre-specified patterns are used to form the base layer host pattern library (Block 24) and, independently, the overlay pattern library (Block 50), from which the respective base patterns and overlay pattern(s) are chosen and/or manipulated. Preferably, a series or group of overlay patterns is selected to coordinate with a specific base pattern (Block 14). Instructions from the designer (Block 10) are used as input to the processes depicted in FIGS. 3 and 6 for creating the base pattern and for selecting the overlay pattern (s), respectively. These instructions specify, for example, which, if any, manipulations are to be performed on the patterns prior to their use as components to form the respective composite patterns and which overlay patterns are to be used with a specific base pattern. Following the generation of the base pattern and the selection of the overlay pattern(s), these respective patterns, having been sized and assigned to appropriate layers, are combined (Block 16) to form a composite pattern of the appropriate scale (e.g., sized to fit the face of a carpet tile) which, in turn, is converted into patterning instructions for the desired patterning machine (Blocks 18 and 20). An example of a suitable conversion process may be found in commonly assigned U.S. Patent Application Publication No. 2005/0206935 to Cox et al., the contents of which are hereby incorporated by reference. By varying the order of selection of the overlay pattern(s) and, optionally, by varying the appearance of the base layer (through selection and/or manipulation), an entire series of non-repeating patterns may be generated that, although unique in appearance within the series, contain one or more common design elements or colors.

Generation of Base Host Pattern and Base Pattern

Figure 2:
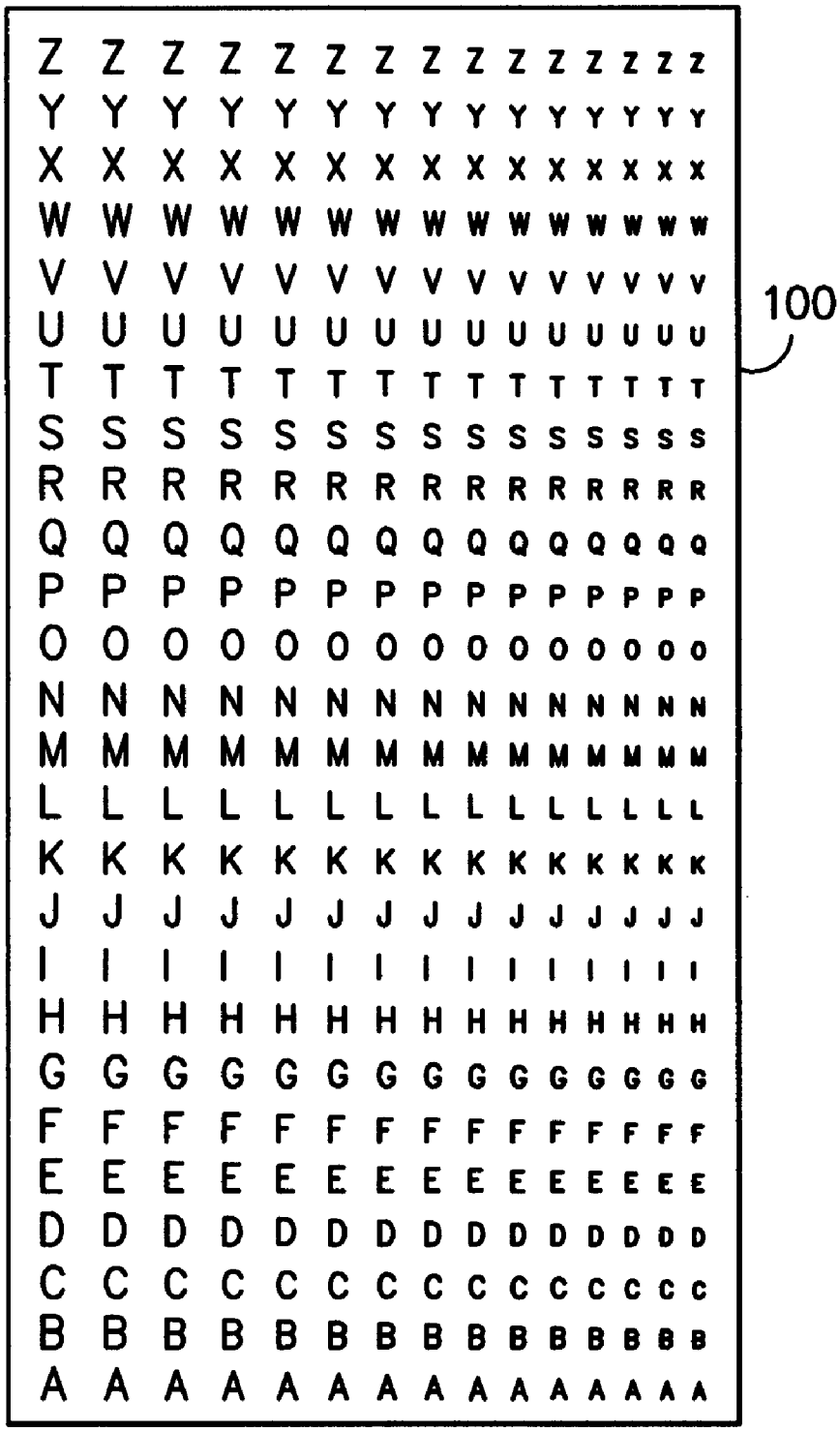
FIG. 2 schematically depicts a base layer host pattern 100, which is stored in digital form and which may be used as part of the process depicted in FIG. 3. In one embodiment, it is a desirable characteristic of the base layer host pattern, which is virtual in nature, that it is non-repeating along any line of sight within the host. This is schematically depicted in FIG. 2 by having individual letters of the alphabet (representing individual pattern elements within a pattern) appear in steadily decreasing size (left-to-right) in rows across the width of the host pattern, and ascending letters of the alphabet (again representing individual pattern elements) arranged in columns along the length of the host pattern. Because there is no pattern repeat, no recognizable portion of the host pattern is superimposable on any other similarly sized portion of the host.

A schematic representation of a base layer host pattern 100 is shown in FIG. 2. It is contemplated that the virtual base layer host pattern(s) will be pre-generated either manually or by automated means and placed in a virtual host pattern library (Block 24 of FIG. 3) for access by the automated patterning software at the appropriate time.

The concept of the host pattern is straightforward—it is a relatively large virtual pattern within which a smaller virtual template (e.g., conceptually analogous to a "cookie cutter") can be positioned to define a subset or sample of the host pattern. Where, as here, the host is preferably comprised of a pattern having a non-repeating nature, the composition of the pattern defined within the boundaries of the template is entirely a function of the location (and rotational orientation) of the template within the host. So long as the location and orientation of the host is seldom repeated exactly, the resulting pattern defined within the template will seldom be duplicated exactly.

For purposes of the first and second embodiments that will be discussed herein, the base host pattern has the same size and shape as the substrate onto which the base pattern will be printed (that is, the host pattern and the tile are of the same dimensions). In a first embodiment, the base pattern may optionally be manipulated before being superimposed by the overlay pattern. In a second embodiment, the tiles in the series share the same underlying base, or background, pattern, which serves to unify the tile series. In yet another variation, it is contemplated that the base pattern template may be the same size as a carpet tile or may be larger or smaller than a carpet tile (as determined by the designer), with appropriate adjustments made for processing the extracted pattern defined within such a template so that the resulting pattern, when placed in a layer, will have the desired scale relative to the size of the carpet tile. For example, if the template is smaller than the carpet tile, then that pattern may be used in connection with a border or similar artistic device to fill the face of the carpet tile. Alternately, the desired pattern may be electronically enlarged to fit the face of the carpet tile to be patterned, or multiple patterns may be extracted or otherwise generated, either from the original extracted pattern or in combination with one or more other pattern(s) extracted from the host pattern. In the latter case, where multiple patterns are to be used, the various patterns may be electronically "stitched," collaged, or otherwise combined to form a pattern that is aesthetically pleasing for use on the face of the carpet tile.

In the third embodiment, the host pattern may be significantly larger than the individual tile dimensions, thus enabling the selection of a large variety of different, but coordinating, tiles, as will be discussed below. By way of illustration only, the base layer host pattern 100 of FIG. 2 is shown as being comprised of letters of the alphabet of various sizes, with the individual letters representing non-repeating pattern elements and no individual letters being exactly superimposable or congruent. This arrangement defines a host pattern that is everywhere unique with no pattern repeats. The size of the base host pattern relative to the base pattern template may vary, so long as the host is at least somewhat larger than the template. The larger the host pattern relative to the size of the base pattern template, the greater the chances that the extracted pattern will have no partial pattern repeat in common with any other pattern extracted from that host. It is preferred, therefore, that the host pattern be at least sufficiently large to contain at least two completely unique tile patterns, i.e., ones in which the template is capable of at least two different non-overlapping placements within the host. Ideally, the host will be everywhere unique and sufficiently large that dozens of non-overlapping template placements are possible. This condition will maximize the number of non-identical patterns of the size and shape of a carpet tile that may be produced from a single host. However, it is contemplated that hosts in which the pattern is merely non-repeating over a substantial portion of the host design also may be used, if desired.

Figure 3:
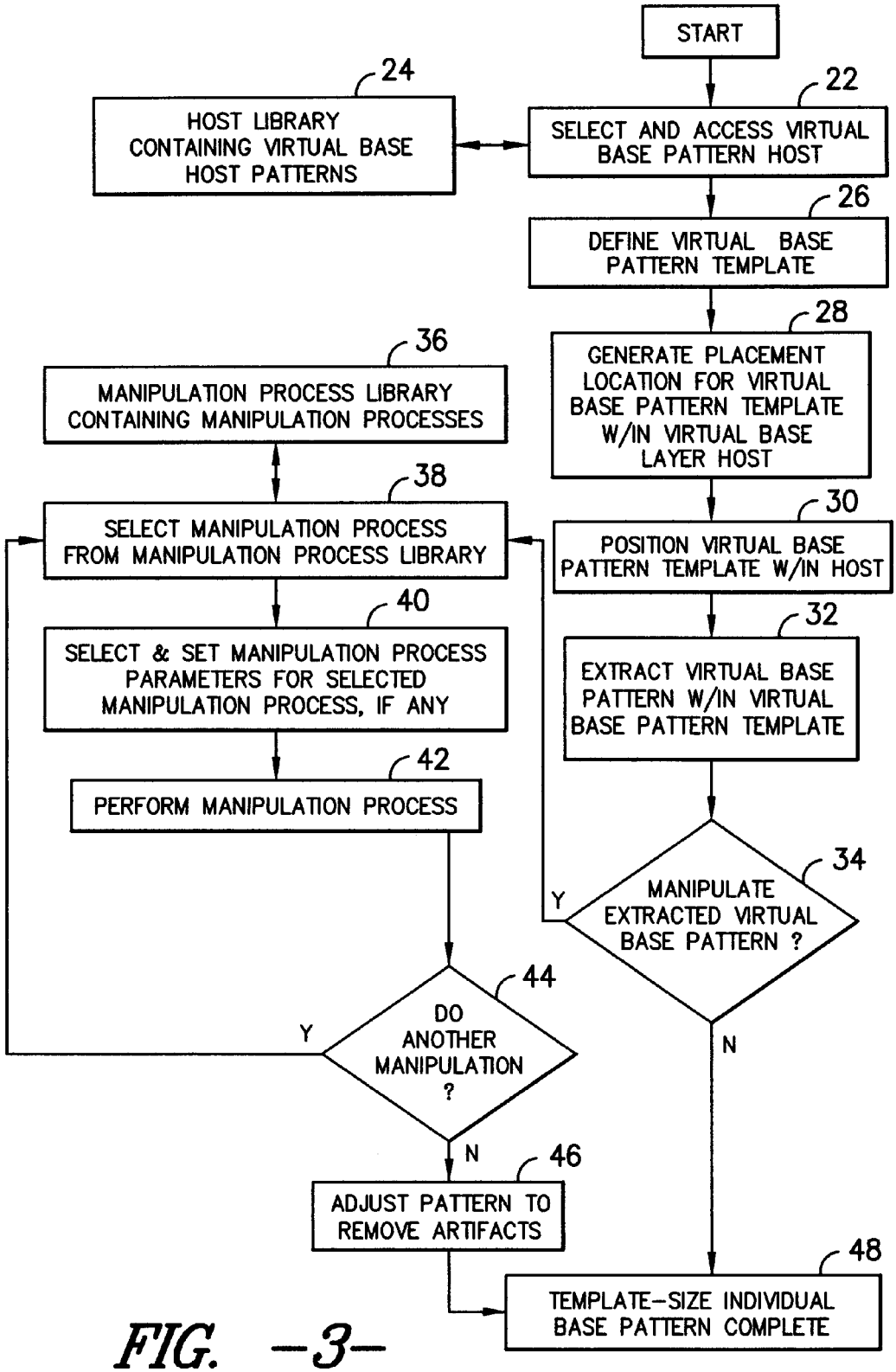
FIG. 3 is a flow diagram describing, in summary fashion, exemplary sub-processes useful in generating a base pattern, with optional pattern manipulation, described in more detail below.

Assuming that a base layer host pattern has been generated and stored in the base layer host pattern library (Block 24 of FIG. 3), the remainder of FIG. 3 depicts exemplary steps that may be used to generate a base pattern for an individual carpet tile in accordance with the teachings herein. Block 22 requires the selection, accessing, and loading of a specific pre-defined virtual base layer host pattern (perhaps from a collection of several such host patterns) from the base layer host library 24, generally performed pursuant to instructions from the designer. In Block 26, the base pattern template is defined. For the sake of discussion, a square template 36 inches on a side, to match the shape and dimensions of a commercial carpet tile, may be assumed. It is expected that this step also will be done with designer input, although, as with the generation of the base layer host pattern, it is foreseen that this step could be automated through the use of pattern generation software algorithms and random or pseudo-random number generators.

At this point, the design of the base pattern may be accomplished in one of several ways. In a first approach, the base layer host pattern and the base layer template are the size of the substrate (that is, the tile) to be printed. Thus, all of the tiles produced for a given series are unified by a common base layer, or background. To produce a tile series where all of the tiles have the same base layer, the process shown in FIG. 3 progresses from Block 26 to Block 48. Alternately, in situations where the designer prefers to use similar, but not identical, base layers, the base layer may be manipulated with the process moving directly from Block 26 to Block 34.

Finally, in an embodiment in which unique base layers are desired, the process proceeds essentially as described below. Block 28 represents a primary opportunity for completely automated activity by the software. Provided some point associated with the template has been designated as the "location" of the template (e.g., a center point or a specified corner), that point can then be assigned anywhere within the host design, thereby specifying a proposed placement location within the host for the (pre-defined, virtual) base layer template. The generation of a location for placement of this virtual template is preferably done through the use of software algorithms using random or pseudo-random numbers, but can also be done through other more deterministic means (e.g., use of a pre-determined list of designer-specified location co-ordinates). Any selected location, however, must be subject to certain constraints that prevent any part of the template, if positioned at the selected location, from falling outside the boundaries of the host. This can be accomplished through appropriate software tests and subroutines that are included in Block 30 and that provide for repositioning and re-testing of the template or the "wrapping" of the template to the opposite edge of the host. Alternatively, the software can perform a predetermined geometric manipulation on that portion of the pattern that is within the host boundary (e.g., fill in the area outside the host boundary with a mirror image of the portion of the pattern closest to the host boundary) to prevent any part of the pattern within the template from being blank.

Once the template location has met the above tests, the base pattern template can be positioned within the virtual host (Block 30), and the portion of the host pattern falling within the boundaries of the template can be defined or "extracted," thereby forming the base pattern (Block 32). FIG. 4 depicts a base host pattern, onto which has been positioned a carpet-tile-sized template at four locations (at dashed lines), yielding the candidate base patterns shown at 15, 25, 35, and 45. It should be noted that, although a square template that is intended to be congruent with the printable surface of a carpet tile is shown, the size and shape of the template is somewhat arbitrary.

In FIG. 5A, the patterns 15, 25, 35, and 45 represent the extracted base patterns from the base layer pattern host 100 shown in FIG. 4, each of which could be used to form a composite pattern on a separate respective carpet tile (i.e., four different patterns for four different carpet tiles). As can be seen, each of these base patterns is distinctly different from each other, thereby making less important the option of further pattern manipulation.

At this point, the software checks to determine if any manipulation of the extracted base pattern has been requested by the designer (or as the result of a software algorithm using a random or pseudo-random number generator). The basic operations for the manipulation process are shown in Blocks 36 through 42 of FIG. 3 (for the base layer) and 56 through 62 of FIG. 6 (for an overlay layer), and are similar in both cases. Manipulation processes that are contemplated include, but are not limited to, rotations, re-scalings (i.e., expansions and contractions of all or portions of the extracted pattern), mirror imaging (either along an edge or along some selected axis), or the use of more complex, multistep processes (e.g., generating and superimposing a checkerboard pattern on the extracted pattern wherein the checkerboard itself is comprised of some geometric translation of the extracted pattern). In the case of the overlay patterns, the preferred manipulation steps are rotation (preferably in 90-degree increments), mirror-imaging along an edge, and a combination of rotation and mirror-imaging. In addition to the foregoing operations, it is contemplated that the desired pattern manipulation might include the formation of a collage of several extracted patterns, in which the random element might be the selection of the extracted patterns to be used, or might be the positioning of the selected extracted patterns, or a combination (i.e., the random placement of randomly-selected extracted patterns).

In carrying out such manipulations, it is foreseen that situations will arise in which certain artifacts of the manipulation process must be addressed. Among such situations, which are offered as examples only, and are not intended to be exhaustive, comprehensive, or limiting in any way, are the following:

1. The template used to extract the sample pattern from the host generates a pattern that, when rotated, no longer is capable of covering the carpet tile to the desired degree. For example, a 36 inch square carpet tile cannot be entirely covered by a 36 inch square sampled pattern if the sampled pattern is to be rotated 45 degrees, thereby placing the 36 inch width of the sampled pattern along the roughly 51 inch diagonal of the 36 inch carpet tile. Similarly, the same sampled pattern, when centered on the face of a 36 carpet tile, will result in a "diamond-on-square" configuration that leaves all four corners of the carpet tile unpatterned. This can be addressed in several ways, including always using a template of sufficient size or shape that the shortest dimension of the sampled pattern equals or exceeds the longest dimension of the carpet tile to which the sampled pattern is to be applied. Alternatively, it is contemplated that the software can, on a trial basis, rotate and superimpose the extracted pattern onto a virtual model of the carpet tile, identify areas of non-coverage (assuming full coverage is desired), and either stretch or replicate portions of the sampled pattern sufficiently to provide the desired coverage.

It should also be noted that, when digital patterns formed by discrete square or rectangular pixels are rotated, the rotation causes the individual pixels to collectively change their orientation, with the border defining each pixel changing from having a horizontal/vertical orientation with respect to the viewer to having an oblique or diagonal orientation with respect to the viewer. This change causes, among other effects, a "stair step" effect for lines directed along diagonals in the pattern.

2. The extracted pattern does not fully cover the surface of the carpet tile to the desired degree (e.g., the template used to extract the pattern has a smaller area or is of a shape that does not meet or overlap all the edges of the carpet tile). This can be addressed by simply re-scaling the sampled pattern or by replicating the pattern (or portions thereof) sufficiently to provide the desired coverage of the carpet tile. Similarly, it is possible that the extracted pattern is too large for the selected carpet tile, in which case the extracted pattern can be re-scaled downward to an appropriate size.

In both Situations 1 and 2 above, the software necessary to perform these operations is well known and can be configured to perform these steps without designer intervention.

If no manipulation has been requested, the generation of the base pattern is complete for an individual carpet tile, and the base pattern may be stored for use in Block 16 of FIG. 1. If manipulation has been requested, then Blocks 36 through 44 of FIG. 3 are used to select, access and load a manipulation algorithm from a manipulation algorithm library (Blocks 36 and 38), select and set appropriate algorithm parameters (e.g., specifying the amount of pattern rotation, the degree of resizing, etc.) (Block 40), executing the selected algorithm (Block 42), and determining if additional manipulation steps are to be carried out (Block 44). These steps may be carried out with designer input or may be a decision left to another algorithm (e.g., using random numbers) and may be repeated as often as desired via Block 44.

Examples of base patterns following such manipulations are shown at 15A, 25A, 35A, and 45A in FIG. 5B. Pattern 15A has been enlarged and flattened, pattern 25A has been reduced in size, with pattern elements added to fill those areas within the base pattern that would otherwise be blank; pattern 35A has been rotated, with the addition of non-rotated pattern elements appearing in the corners to fill areas that would otherwise be blank; and pattern 45A has been mirror-imaged and rotated 90 degrees. As shown, all are sized for use in a carpet tile base layer.

When all desired manipulation algorithms have been run, it may be necessary to adjust the manipulated pattern, via appropriate software, to remove patterning artifacts such as those discussed above, as well as excessive "stair-stepping" in diagonal line segments, etc, as shown in Block 46. The adjusted base pattern, symbolized at Block 48 of FIG. 3, is then sent to Block 16 of FIG. 1 as a component of the composite pattern to be generated.

Generation of Overlay Host Pattern and Overlay Pattern

Representative steps for the formation of an overlay pattern for an individual carpet tile are depicted in FIG. 6. Several notable differences between these steps and those used to create a base pattern may arise, however, depending upon the final patterning effect desired in the tile series. One difference is associated with the fact that the overlay patterns are preferably pre-defined and stored in an overlay pattern library for combination with a particular base layer. A second difference arises from the fact that, generally speaking, the base pattern will be configured to accommodate the size and shape of the individual carpet tile, whereas certain overlay patterns may be intentionally much smaller than the carpet tile, so that the overlay pattern is wholly contained within the tile's dimensions. A third difference arises from the fact that, in those embodiments where the relative size of the base pattern host is significantly larger than the size of the typical base pattern template, there is a reduced need to have the base pattern undergo manipulation in order to generate a large number of unique base patterns. This is not necessarily true of the patterns used for the overlay layer, and, accordingly, the option of using manipulation software to re-configure the overlay pattern is likely to be of greater value in producing a variety of unique, but related, composite patterns.

As set forth in FIG. 6, the designer preferably develops a series of overlay patterns (Block 8), using any techniques known for pattern generation. The pre-defined overlay pattern is selected (Block 52) from an overlay pattern library (Block 50). The selection of a particular overlay pattern from the overlay pattern series may be accomplished manually (that is, with specific designer input), or perhaps preferably by using a computer algorithm that is programmed to randomly select each of the overlay patterns in the series before repeating a selection. This process introduces a random order to the production of the tiles in a series, thereby resulting in a random appearance of the tile collection when installed without the need for shuffling or re-arranging tiles as part of the installation process.

Optionally, the overlay pattern may be manipulated (Block 54) before being superimposed on the base pattern. In the interest of simplicity, the manipulation process library (Block 56) may contain only a few manipulation operations to be performed. For example, the manipulation operations to be performed on the overlay pattern can be limited to rotations (most preferably, in 90-degree increments), mirror-imaging (most preferably, along an edge), and rotations combined with mirror-imaging. Using these simpler manipulation techniques (as compared with those optionally used to manipulate the base pattern), eight variations of a given overlay pattern may be created, as shown in FIG. 7, where a simplified geometric pattern has been used for purposes of illustration only. Although these eight manipulations are likely to be sufficient for most tile installations, any number of different manipulation processes may be used, either alone or in combination. Optionally, the manipulation process library may include repositioning of a design element on the tile, preferably in such a way as to prevent the design element from overlapping the edges of the tile (that is, the element is not cut-off), or translating, stretching, or compressing various design elements.

If manipulation is desired, then Blocks 54 through 62 of FIG. 6 are used to select, access and load a manipulation algorithm from a manipulation algorithm library (Blocks 56 and 58), select and set appropriate algorithm parameters (e.g., specifying the amount of pattern rotation and/or mirror-imaging along a given edge) (Block 60), and executing the selected algorithm (Block 62). These steps may be carried out with designer input or may be a decision left to another algorithm (e.g., using random numbers).

As with the base pattern, it may be necessary to adjust the manipulated overlay pattern, via appropriate software, to remove patterning artifacts such as those discussed above, as well as excessive "stair-stepping" in diagonal line segments, etc, as shown in Block 64. The adjusted overlay pattern, symbolized at Block 66 of FIG. 6, is then sent to Block 16 of FIG. 1 as a component of the composite pattern to be generated.

Turning now to FIG. 7, eight unique overlay patterns are depicted, which are produced by manipulating (that is, rotating and mirror-imaging) the single overlay pattern shown in the upper left corner. Using this approach, where all tiles have the same base layer and where there is "N" number of overlay patterns, the number of unique tiles in the series is 8N. Obviously, in embodiments where the base pattern is randomly chosen from a base layer pattern host or where the base layer is a pre-defined pattern that is subsequently manipulated before being combined with a pre-defined overlay layer, the number of unique tiles in a series may be considerably larger. However, for purposes of discussion, the "series" will still be referred to as having the same number of tiles as there are overlay pattern and manipulated overlay patterns (that is, the series will share a common, fixed base pattern).

FIG. 8A shows one embodiment of the present process, in which a pre-defined base pattern 80 and an overlay pattern grid 200 are used to create a series of tiles. Preferably, each of the overlay patterns in the grid is unique, and, again preferably, related to one another by color, design element, or the like, so that the composite patterns produced have design continuity that reinforces the continuity imparted by the base pattern. For discussion purposes only, the 3×4 grid may be numbered from 1 to 12 left-to-right and top-to-bottom, as shown in the corresponding numbered grid. It should be noted that, although twelve overlay patterns are shown, any number of overlay patterns may be employed. Likewise, although the overlay patterns are arranged in FIG. 8A in a grid configuration, alternate configurations for the overlay patterns may be used (for example, a straight line, a 2×6 grid, "stacked" layers of a single pattern, discontinuous individual units, etc.). As described previously, the production of each series of tiles is achieved by random selection of the overlay patterns within the array, representative examples of which are shown below:

| | |
|---|---|
| Series 1: | 4, 9, 1, 8, 11, 10, 2, 3, 7, 12, 5, 6 (as shown in FIG. 8B) |
| Series 2: | 10, 6, 9, 2, 3, 11, 5, 4, 1, 8, 12, 7 |
| Series 3: | etc. |

Subsequent series would be similarly produced, using overlay patterns in an order that is randomly selected.

FIG. 9A shows a 4×6 grid of overlay patterns 300 for combination with a base pattern 80 (see FIG. 8A). In this instance, the base and overlay patterns may be considered as numbered from 1 to 24, with the base pattern 80 being positioned in square 1. Preferably, each of the overlay patterns in the remainder of the grid (that is, squares 2-24) is unique, and, again, preferably, is related to one another by color, design element, or the like, so that the composite patterns produced have design continuity that reinforces the continuity imparted by the base pattern. For discussion purposes only, the 4×6 grid may be numbered from 1 to 24 left-to-right and top-to-bottom, as shown in the corresponding numbered grid. It should be noted that, although 23 overlay patterns are shown, any number of overlay patterns may be employed. Likewise, although the overlay patterns are arranged in FIG. 9A in a grid configuration, alternate configurations for the overlay patterns may be used (for example, a straight line, a 2×12 grid, a 3×8 grid, "stacked" layers of a single pattern, discontinuous individual units, etc.). To increase the number of possible overlay patterns, each of the patterns may be manipulated in one of eight ways, as previously described, resulting in the production of a series of 184 tiles. Using a computer algorithm, each of the 184 overlay layer variations is chosen before the series begins to repeat.

FIG. 9B shows representative composite patterns created using various overlay layers (some of which have been manipulated) from array 300 with base layer 80. Overlay layers numbered 2, 7, 19, 23, 18, 8, and 5 are shown as being incorporated into their respective composite patterns without manipulation. Overlay layers number 11 and 13 have been rotated 90 degrees clockwise before being incorporated into their respective composite patterns. Overlay layer 7 is shown in two variations: as originally created (top row) and after having been mirror-imaged (middle row), as may happen with the randomized computer algorithm. Overlay layer 4 has been rotated clockwise 270 degrees from its original orientation before being incorporated into a composite pattern. Finally, overlay layer 24 has been rotated clockwise 90 degrees and then mirror-imaged.

FIG. 10A shows a 4×6 grid of overlay patterns 300 for combination with one of base patterns 15, 25, 35, and 45. In this instance, the overlay patterns may be considered as numbered from 1 to 24. Preferably, each of the overlay patterns in the grid is unique, and, again, preferably, the overlay patterns are related to one another by color, design element, or the like, so that the composite patterns produced have design continuity that reinforces the continuity imparted by the base pattern. For discussion purposes only, the 4×6 grid may be numbered from 1 to 24 left-to-right and top-to-bottom, as shown in the numbered grid corresponding to FIG. 9A. It should be noted that, although 24 overlay patterns are shown, any number of overlay patterns may be employed. Likewise, although the overlay patterns are arranged in the FIGURES in a grid configuration, alternate configurations for the overlay patterns may be used (for example, a straight line, a 2×12 grid, a 3×8 grid, "stacked" layers of a single pattern, discontinuous individual units, etc.).

In one embodiment, to increase the number of possible overlay patterns, each of the patterns may be manipulated in one of eight ways, as previously described, resulting in the production of a series of 192 tiles. Using a computer algorithm, each of the 192 overlay layer variations is chosen before the series begins to repeat.

Alternately, the base layers 15, 25, 35, and 45, for example, may be chosen and/or manipulated, using a wide array of manipulation techniques, to create a vast number of possible base layers. Each of these base patterns, which are randomly chosen from a base layer pattern host and which may or may not be manipulated, may then be combined with each of the previously described overlay patterns. Examples of the resulting composite patterns are shown in FIG. 10B, the details of which are provided below. The identifying numbers assigned to the overlay patterns of FIG. 10A correspond to the numbered grid used in FIG. 9A (that is, 1 in the upper left, 4 in the upper right, 24 in the lower right, etc.).

| | |
|---|---|
| Row 1, pattern 1: | Base pattern 25; overlay pattern 6 |
| Row 1, pattern 2: | Base pattern 15A (see FIG. 5A); overlay pattern 8 |
| Row 1, pattern 3: | Base pattern 45; overlay pattern 14 |
| Row 1, pattern 4: | Base pattern 25A (see FIG. 5A); overlay pattern 17 (rotated 180 degrees) |
| Row 2, pattern 1: | Base pattern 35; overlay pattern 1 (mirror-imaged) |
| Row 2, pattern 2: | Base pattern 45A (see FIG. 5A); overlay pattern 20 |
| Row 2, pattern 3: | Base pattern 15; overlay pattern 7 (rotated 90 degrees) |
| Row 2, pattern 4: | Base pattern 35 (mirror-imaged); overlay pattern 15 |
| Row 3, pattern 1: | Base pattern 15 (rotated 90 degrees); overlay pattern 9 (rotated 270 degrees) |
| Row 3, pattern 2: | Base pattern 45 (rotated 90 degrees); overlay pattern 22 |
| Row 3, pattern 3: | Base pattern 25 (mirror-imaged); overlay pattern 3 |
| Row 3, pattern 4: | Base pattern 15A (see FIG. 5A) (rotated 270 degrees); overlay pattern 11 (rotated 90 degrees) |

From these representative examples, it is apparent that the possible combinations of base patterns and overlay patterns (both of which may be manipulated) is vast, thereby ensuring the randomness of the appearance of the installation, even where thousands of tiles might be involved. As shown above, one or both of the base pattern and the overlay pattern may be manipulated separately. Alternately, neither may be manipulated. In yet other embodiments, two manipulations may be used on a single layer, as in the fourth composite pattern of Row 3 where the base pattern has been manipulated twice.

Figure 11:
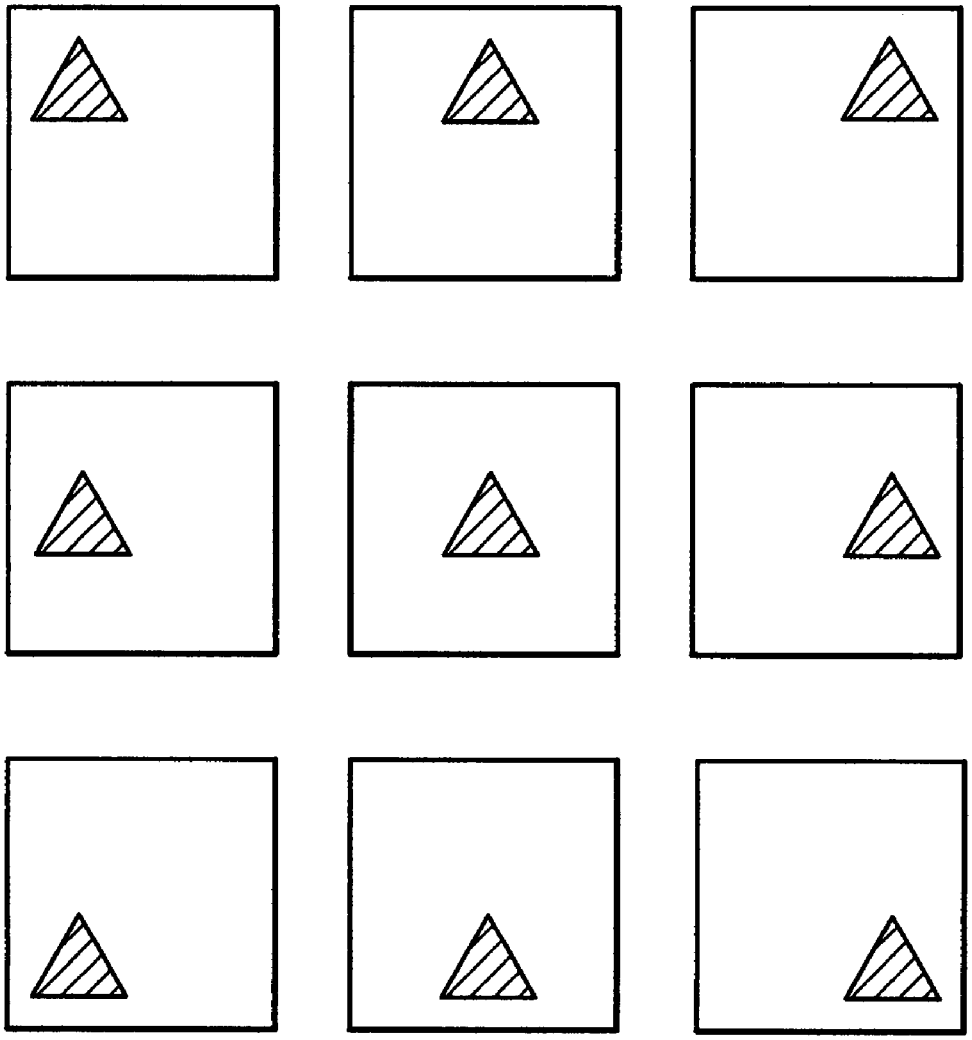
FIG. 11 schematically depicts a series of overlay patterns in which the design element of the overlay pattern is translated or shifted before being combined with the base pattern to form a composite pattern. It should be understood that the degree of shift may be limited by the size of the design element and the desire to contain the design element within the borders of the tile. Further, it should also be understood that such shifts may be accomplished manually (for example, by providing multiple overlay layers within a tile series) or automatically by a computer algorithm that prevents the design element from overlapping an edge of the tile.

Yet another possibility for manipulating the overlay pattern is shown in FIG. 11, in which the same design element (a triangle) is translated or repositioned to various locations across multiple representative tiles. Obviously, the size of the design element will dictate to what extent a particular element may be repositioned on a tile, preferably without overlapping an edge of the tile. Such repositioning may occur manually, for instance, by a designer who creates multiple overlay layers with repositioned design elements. Alternately, computer algorithms may be used to randomly reposition the design element. In those cases where the design element is a proprietary design, such as a trademark, logo, or other insignia, it is preferable that repositioning be the only manipulation process used. As an example, it is believed to be undesirable to mirror-image a logo, thereby altering its appearance.

Returning again to FIG. 1, following the creation of the desired base pattern and the selection and/or manipulation of the overlay pattern, the results are electronically superimposed (Block 16) using techniques known to those of skill in the art to form a composite pattern which, for purposes of patterning machine processing, is fundamentally identical to a conventionally-derived pattern, and therefore requires no special processing to convert the pattern data to firing instructions for the specific patterning machine to be used. One such machine, a Millitron® textile patterning machine manufactured by Milliken & Company of Spartanburg, S.C., is depicted in FIG. 12. The computer and electronic control system depicted in FIG. 12 are used to perform some of the steps shown in FIG. 1, such as processing the composite pattern data by converting the pattern data into dye applicator actuation commands (Block 18) and sending the appropriate commands, at the appropriate time, to the individual dye applicators (Block 20). Details of this machine can be found in any of several issued U.S. patents, including U.S. Pat. No. 6,181,816 and U.S. Pat. No. 7,072,733, the contents of which are hereby incorporated by reference. It is believed that, with adaptations that would be apparent to one of ordinary skill, the composite pattern of Block 16 would also be compatible with other textile patterning machines, such as the Chromojet® Carpet Printing Machine available from Zimmer Machinery Corporation of Spartanburg, S.C.

It is contemplated that the carpet tile blanks to be patterned by, for example, a Millitron® textile patterning machine, may be of any suitable construction (e.g., hardback, cushion back, etc.). It is assumed that the face may be constructed of any appropriate textile materials in yarn or pile form that are suitable for dyeing or patterning, and may have a face height or pile height that is uniform or non-uniform (e.g., may be textured, as found in a multi-level loop pile) created by tufting, needling, flocking, bonding, etc., or the use of woven or non-woven substrates.

It should be understood that, while the FIGURES and discussion above are directed to the patterning of individual carpet tiles, the techniques disclosed above are not necessarily restricted to carpet tiles, but may also be used, with appropriate adaptation as will be readily apparent to those skilled in the art, to pattern broadloom carpeting or other substrates.

We claim:

1. A process of generating a series of randomly ordered virtual composite patterns and applying the series of composite patterns onto a series of textile substrates such that no individual textile substrate in the series carries a pattern that is identical to the pattern of any other textile substrate in the series, said process comprising:

(a) creating a base pattern;

(b) establishing an overlay pattern library of predetermined overlay patterns, each of said predetermined overlay patterns having a pattern that is not identical to the pattern of any other overlay pattern in said library;

(c) forming a series of composite patterns, each composite pattern comprised of a base pattern and at least one overlay pattern, said series being formed by randomly selecting different overlay patterns from said overlay pattern library until each overlay pattern is chosen; and, (d) applying the series of composite patterns onto a series of textile substrates.

2. The process of claim 1, wherein said step of creating a base pattern is subjected to electronic manipulation prior to the formation of said series of composite patterns.

3. The process of claim 1, further including the step of subjecting at least one of the overlay patterns to electronic manipulation prior to the formation of said series of composite patterns, said electronic manipulation using at least one technique selected from the group consisting of rotating, mirror-imaging, rotating and mirror-imaging, and repositioning.

4. The process of claim 1, wherein said base pattern, and said overlay pattern in at least one composite pattern are separately manipulated prior to the formation of said composite pattern.

5. The process of claim 1, further including the step of establishing a base host pattern library of predetermined base host patterns, and wherein said step of creating the base pattern includes creating the base pattern from one of the base host patterns in the base host pattern library.

6. The process of claim 5, wherein said step of creating a base pattern includes selecting a portion of the host base pattern for the base pattern that is defined by the boundaries of a virtual template that is positioned on said host base pattern.

7. The process of claim 1, wherein the step of forming the series of composite patterns includes the overlay pattern of the each composite pattern in the series of composite patterns being a different overlay pattern than in any other composite pattern in the series of composite patterns.

8. The process of claim 1, wherein the step of forming the series of composite patterns includes using only the base pattern and overlay patterns from the library of predetermined overlay patterns.

9. The process of claim 1, wherein the step of applying the series of composite patterns onto a series of substrates includes applying the series of composite patterns onto the series of substrates without including patterns other than the composite patterns from the series of composite patterns.

10. The process of claim 1, wherein the step of applying the series of composite patterns onto the series of substrates includes placing the series of composite patterns on a single substrate and then separating the single substrate into the series of substrates.

* * * * *